US006574983B2

(12) United States Patent
Smith et al.

(10) Patent No.: US 6,574,983 B2
(45) Date of Patent: Jun. 10, 2003

(54) ALL PURPOSE PORTABLE ICE CHEST

(76) Inventors: Lester Smith, 7708 N. Ware Rd., McAllen, TX (US) 78504; Roberto Gonzalez, 1323 St. Marie, Mission, TX (US) 78572

( * ) Notice: Subject to any disclaimer, the term of this patent is extended or adjusted under 35 U.S.C. 154(b) by 0 days.

(21) Appl. No.: 09/955,024

(22) Filed: Sep. 19, 2001

(65) Prior Publication Data

US 2003/0051502 A1 Mar. 20, 2003

(51) Int. Cl.[7] ..... F25D 3/08
(52) U.S. Cl. ..... 62/372; 62/388; 62/457.7
(58) Field of Search ..... 62/384, 388, 457.1, 62/457.2, 457.7, 372

(56) References Cited

U.S. PATENT DOCUMENTS 2,631,439 A * 3/1953 Feigenbaum ..... 217/18
3,864,936 A * 2/1975 Frank et al. ..... 62/384
4,597,266 A * 7/1986 Entrekin ..... 252/67
5,671,611 A * 9/1997 Quigley ..... 62/371
6,212,901 B1 * 4/2001 Pint et al. ..... 62/265
6,269,651 B1 * 8/2001 Price ..... 62/255

* cited by examiner

*Primary Examiner*—William E. Tapolcai

(57) ABSTRACT

A portable ice chest used for maintaining its contents in a cooled or frozen state for an extended period of time. The ice chest includes an insulated cover with an inner compartment and an insulated container with a bottom compartment. The cover is adapted to fit airtight upon the top opening of the container. To maintain the contents of the ice chest in a frozen state, a refrigerant coolant such as dry ice is placed in the inner compartment only. To maintain the contents of the ice chest in a refrigerated state, a refrigerant coolant such as dry ice is placed in the bottom compartment only. Additionally, when no dry ice is placed in either compartments, the present invention can be used as a regular ice chest.

33 Claims, 4 Drawing Sheets

ALL PURPOSE PORTABLE ICE CHEST

BACKGROUND

The present invention relates to a container for maintaining the contents of the container at a desired temperature for an extended period of time. More specifically, the present invention relates to maintaining the contents of a portable ice chest at a desired temperature for an extended period of time. The present invention is for use in family outdoor outings.

The prior art discloses containers to be used for shipping. For example, U.S. Pat. No. 4,576,017, Combs et al., discloses a container for maintaining its contents at a desired temperature for an extended period of time such as for use in shipping contents in a frozen condition. The container is substantially airtight with a means for maintaining a substantially uniform temperature around the contents of the container. Another example, U.S. Pat. No. 4,294,079 Benson, discloses an insulated container and a process for shipping perishable products utilizing a box having a lid with an internal compartment for storing a suitable refrigerant, such as dry ice.

Additionally, the prior art discloses refrigeration units. For example, U.S. Pat. No. 3,959,982 Denis et al, discloses a refrigeration unit comprising evaporation coil connected to a pressurized liquid refrigerant. The evaporator converts the liquid refrigerant into a gases. A thermostatically controlled valve regulates the flow of refrigerant within the refrigeration unit. A second example, U.S. Pat. No. 3,971,231 Derry, discloses a refrigerator having at least one dry ice carrier removably disposed within the cabinet of the refrigerator. Another example, U.S. Pat. No. 4,288,996 Roncaglione, discloses a sublimation refrigerator having a thermally insulated housing chamber having a smaller insulated dry ice chamber adapted to be supported centrally within the housing chamber. Cooling coils are supported within the insulated walls. Each cooling coil attached to the dry ice chamber.

In the prior art, dry ice is used in portable ice chest. However, portable ice chests have no safety features to protect a user from freezer burns while handling the dry ice. The present invention provides these safety features. This invention provides a means for turning an everyday portable ice chest into an all purpose container that maintains its contents at a desired temperature for an extended period of time.

SUMMARY

The present invention provides an all purpose portable ice chest. The ice chest comprises a container with an airtight cover. The cover further includes an inner compartment with apertures for containing a refrigerant coolant, dry ice. Additionally, the container further includes a bottom compartment with apertures for containing a refrigerant coolant, dry ice. In one aspect of the present invention, the contents of ice chest is kept in a frozen state by placing dry ice within the upper compartment. In another aspect of the present invention, the contents of the ice chest is kept in a refrigerated state by placing dry ice in the bottom compartment along with packing its contents with regular ice. In the present invention the upper and bottom compartments are the safety features that protect a user from handling the dry ice. These compartments contain the dry ice which prevent a user from handling the dry ice.

BRIEF DESCRIPTION OF THE DRAWINGS

For a more complete understanding of the present invention, and the advantages thereof, reference is now made to the following descriptions taken in conjunction with the accompanying drawings, in which.

DETAILED SPECIFICATION

Figure 1:
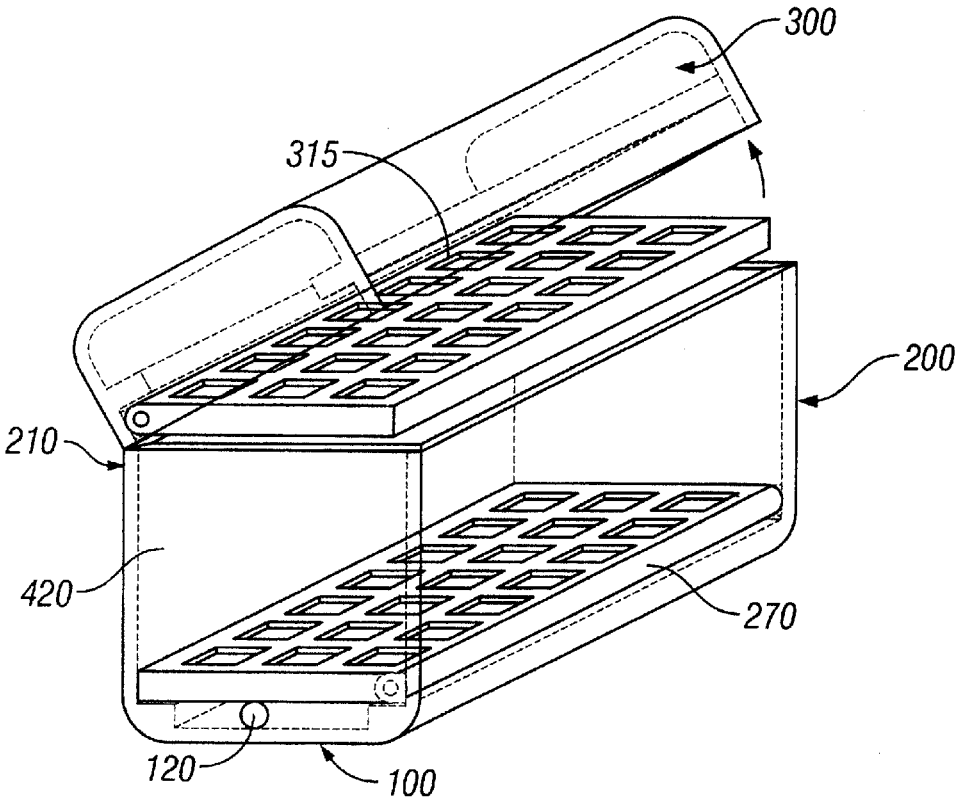
FIG. 1 illustrates a perspective side view of present invention, a hand-held portable ice chest.

Referring to FIG. 1, an overall perspective view of the present invention is seen, a handheld portable apparatus (100) for maintaining its contents at a desired temperature for an extended period of time. In the illustrated embodiment, apparatus (100) is a portable ice chest comprising cooler (200) hingedly connected to cover (300). Cooler (200) has a rectangular configuration and has a size, weight, and a configuration conducive for handheld carrying by a user. The dimensions of the present invention can vary from 24¼ inch×13$^{11}/_{16}$ inches×14⅛ inches to 34¾ inches×16¾ inches×17⅝ inches and can handle between 20 Qts and 94 Qts. However, alternative embodiment of the invention could employ other shapes, such as cylindrical coolers, and other components of the invention could be formed for use with these units. The present invention can be adapted to be used in any commercially available handheld portable ice chest, i.e. igloo and other manufacturers of portable ice chests.

Figure 2:
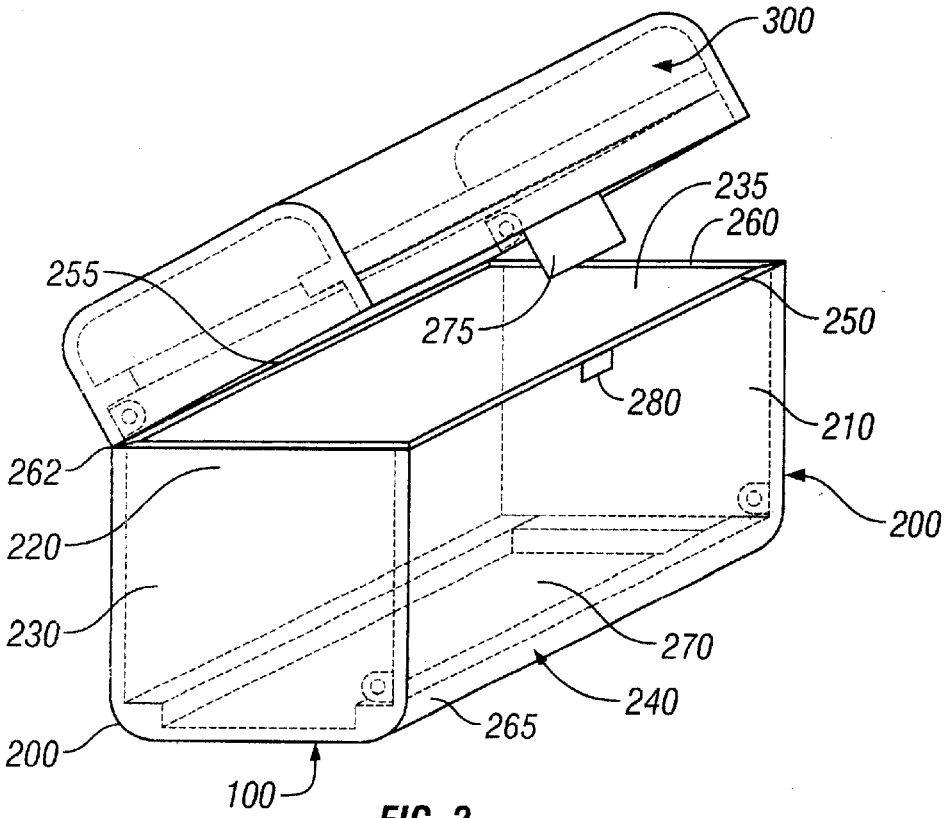
FIG. 2 is an exploded side view of the cooler and cover of the present invention.

Referring to FIG. 2, there is illustrated a side and top view of the cooler (200) and cover (300). In the illustrated embodiment, cooler (200) further includes a front panel (210), a back panel (220), two side panels (230, 235), a bottom panel (240), and a top opening (245). Front panel (210), back panel (220), and each side panel (230, 235) are all adjoined to inner insulated layers (250, 255, 260, 262). Additionally, bottom panel (240) is adjoined to bottom insulated layer (265). Each insulated layer is made of a special manufactured insulating material for maintaining the temperature in the ice chest, for example polyurethane foam or any such type of suitable material.

In the illustrated configuration shown in FIG. 2, bottom insulated layer (265) is adapted to form bottom compartment (270). Bottom compartment (270) forms a bottom cavity within bottom insulated layer (265). The formed bottom cavity is defined by an upper opening (291), two opposing sides (293, 294) and lower portion (292) with enough area volume for containing a refrigerant coolant. The refrigerant coolant can be dry ice or any such suitable material.

Figure 2A:
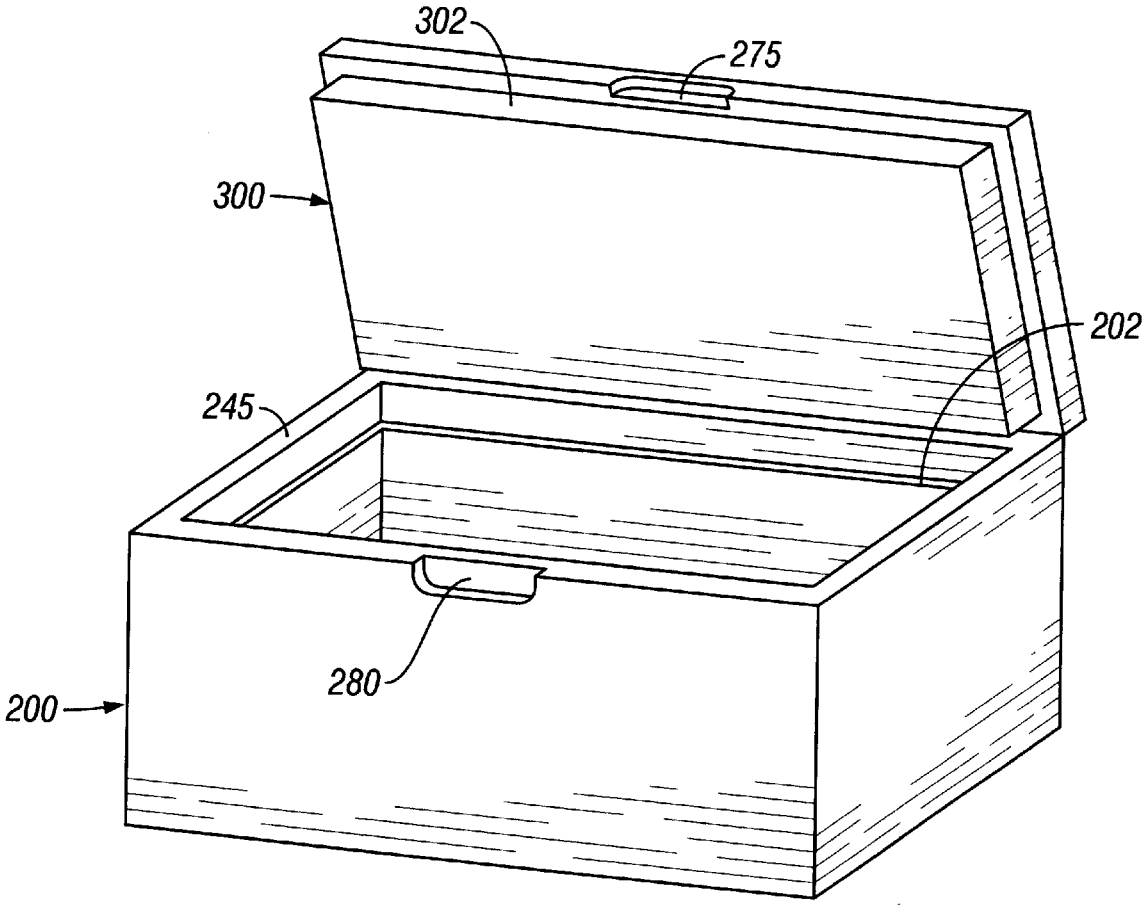
FIG. 2A is an exploded side view of the cooler and cover of the present invention in an opened position.

As illustrated in the embodiment shown in FIG. 2A, cover (300) is adapted to fit airtight upon the top opening (245) of cooler (200). The edges of cover (300) is adapted with recess (302) that fits airtight into the edges (202) of the top opening (245) of the cooler (200). To secure cover (300) airtight to top opening (245), cover (300) is equipped with a latch (275) which can be securely fastened to a complementary catch (280) situated directly across from latch (275) on the outer edge of top opening (245). As further illustrated in FIG. 2, cover (300) is hingedly connected to the top opening (245)

of cooler (200) utilizing a conventional structure. The conventional hinged structure allows cover (300) to traverse from a closed position into an open position in which the cover (300) and the cooler (200) form a 90 degree angle. According to an even more specific embodiment, cover (300) can be adapted to be completely removable from cooler (200). In this kind of embodiment, there is no hinged structure, the entire surrounding edges of cover (300) are adapted with a recess (302) that fits airtight into the edges (202) of the top opening (245) of the cooler (200).

Figure 3:
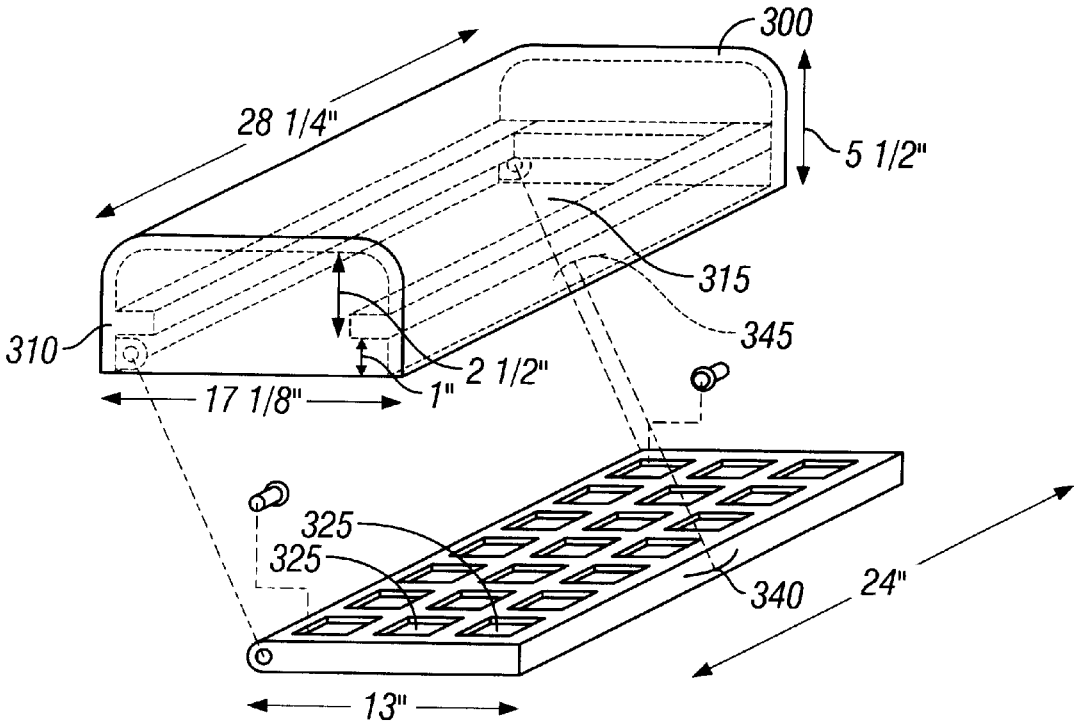
FIG. 3 is an exploded top and side view of the cover of the present invention.

Referring now to FIG. 3, there is illustrated cover (300) having an inner insulated layer (310) adapted to form an inner compartment (315). Inner compartment (315) forms an inner cavity within the cover (300). The formed inner cavity is defined by an upper opening (305), two opposing sides (307, 308), and lower portion (306) with enough area volume for containing a refrigerant coolant such as dry ice. The illustrated embodiment in FIG. 3 further includes an upper grid (320) having a plurality of apertures (325). In the illustrated embodiment, upper grid (320) is rectangular shaped having opposing sides (353, 354). As shown, upper grid (320) has a configuration that is equivalent to the upper opening (305) of the inner compartment (315). Additionally, upper grid (320) has slightly larger dimensions than the upper opening (305) of the inner compartment (315). The upper grid (320) in the illustrated embodiment can be made from a hard plastic material or other such suitable material.

In the illustrated embodiment shown in FIG. 3, upper grid (320) overlays the upper opening (305) of inner compartment (315). As shown, one side (353) of upper grid (320) is hingedly connected to the inner insulated layer (310) on the first side (307) of the inner cavity. The hinged connection is by conventional means using fasteners such as small plastic screws or other type of suitable fasteners. Having upper grid (320) hingedly connected to inner insulated layer (310) provides upper grid (320) the capability of easily traversing from a closed position into an open position wherein upper grid (320) and upper end (305) forms a 90 degree angle.

The illustrated embodiment shown in FIG. 3 further includes a means for securing the upper grid (320) in a closed position. One means of securing upper grid (320) in a closed position is a latch (340) which is centrally located on the opposing side (354) of the upper grid (320). To secure upper grid (320) in a closed position, latch (340) snap locks into a complementary catch (345) which is located directly across from latch (340) within the inner insulated layer (310) on the opposing side (308) of the inner cavity. When the latch (340) is securely locked within catch (345), the upper grid (320) functions as a lid to securely contain the refrigerant coolant within the inner compartment (315). Alternative commercially available means for securing upper grid (320) in a closed position can be adapted to be used in the present invention.

Figure 4:
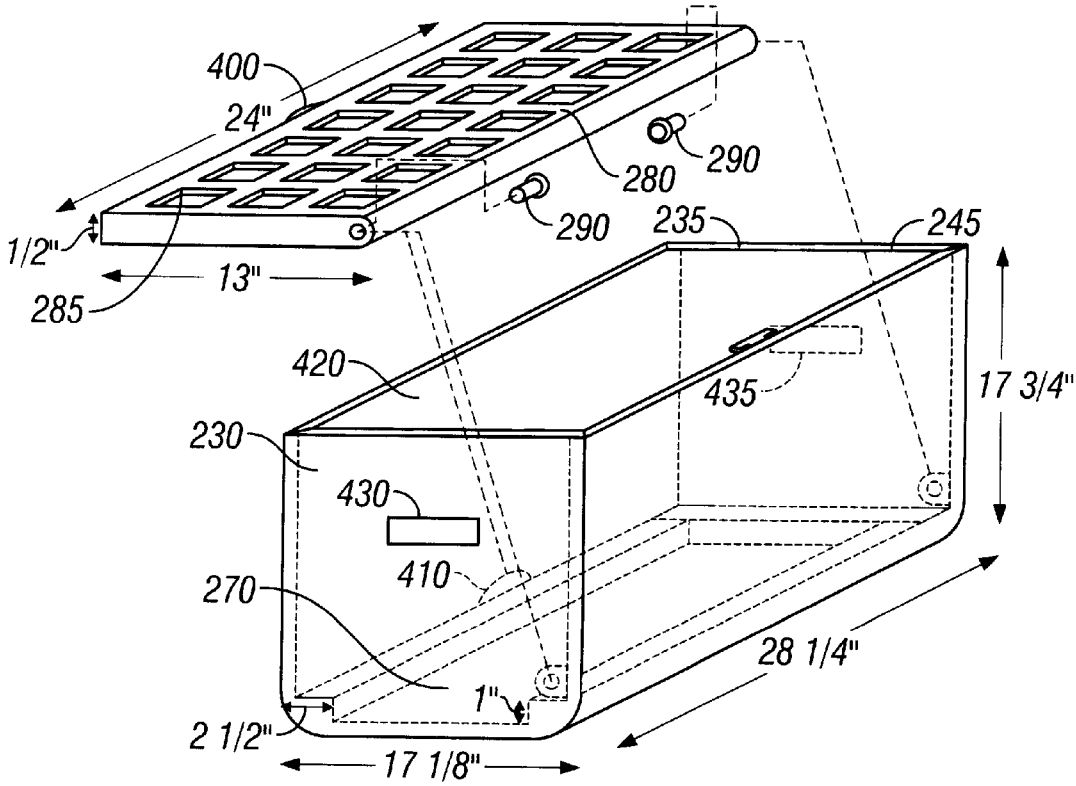
FIG. 4 is an exploded top and side view of the cooler.

Referring now to FIG. 4, there is illustrated an exploded side view of cooler (200). As shown in FIG. 4, the illustrated embodiment further includes a lower grid (280) having a plurality of apertures (285). In the illustrated embodiment, lower grid (280) is rectangular shaped having opposing sides (295, 296). As shown, lower grid (280) has a configuration that is equivalent to the upper opening (291) of the bottom compartment (270). Additionally, lower grid (280) has slightly larger dimensions than the upper opening (291) of the bottom compartment (270). The lower grid (280) can be made from a hard plastic material or other such suitable material.

In the illustrated embodiment in FIG. 4, lower grid (280) overlays the upper opening (291) of the bottom compartment (270). One side (293) of lower grid (280) is hingedly connected to the bottom insulated layer (265) on the first side (295) of the bottom cavity. The hinged connection is by conventional means using fasteners (290) such as small plastic screws. Having lower grid (280) hingedly connected to bottom insulated layer (265) provides lower grid (280) the capability of easily traversing from a closed position into an opened position wherein lower grid (280) and upper opening (291) of the bottom compartment (270) forms a 90 degree angle.

The illustrated embodiment shown in FIG. 4 further includes a means for securing the lower grid (280) in a closed position. One means of securing lower grid (280) in a closed position is a latch (400) which is centrally located on the opposing side (296) of the lower grid (280). To secure lower grid (280) in a closed position, latch (400) snap locks into a complementary catch (410) which is located directly across from latch (400) within the of the bottom insulated layer (265) on the opposing side (295) of the bottom cavity. When the latch (400) is securely locked within catch (410), the lower grid (280) functions as a lid to securely contain the refrigerant coolant within the bottom compartment (270).

The illustrated embodiment in FIG. 4 further includes a pair of handles (430, 435) built into the pair outer side panels (230, 235) of cooler (200). The pair of handles (430, 435) provides the means for a user to easily carry the portable ice chest.

Additionally, the illustrated embodiment in FIG. 4 further includes storage area (420) defined by the area between the top opening (245) and the lower grid (280) of cooler (200). The lower grid (280) separates the load to be cooled from the refrigerant coolant stored in the bottom compartment (270). According to an even more specific embodiment of the present invention, storage area (420) can be increased by traversing lower grid (280) into a 90 degree opened position. In order to obtain this increase in the storage area (420), lower grid (280) is traversed into an opened position and no refrigerant coolant is stored within the bottom compartment (270).

Referring back to FIG. 1, there is illustrated an overall perspective view of the present invention. The illustrated embodiment of the present invention provides the capability of maintaining for an extended period of time the contents of storage area (420) in a frozen state or a cooled state. The primary use of the present invention is for outdoor family outings such as picnics. To maintain the contents of storage area (420) in a frozen state, dry ice is placed only in the upper compartment (315). Then, the load to be kept frozen is placed within storage area (420). In this configuration, as the dry ice sublimates or melts in to carbon dioxide gas, the gas perpetrates though the apertures in the upper grid (315) and the load placed in storage area (420) is maintained in a frozen state for an extended period of time. Additionally, dry ice can be placed in the bottom compartment (270) which extends the time the load is maintained in a frozen state. Since dry ice sublimates or melts into carbon dioxide gas instead of a liquid, dry ice is excellent for refrigeration in this manner.

The present invention can also be used as a normal ice chest. In this configuration, the load stored in storage area (420) is maintained in a cooled state for an extended period of time. To support this configuration, first dry ice is placed only in the bottom compartment (270). Then, the load is placed in the storage area (420). Additionally, the load can be packed in regular ice and the upper compartment (315) can be used as an additional storage area. In this configuration, as the dry ice melts it perpetrates through the apertures (285) in the lower grid (280). However, the gas does not flow upward and freeze the load. The gas is heavier and remains at the bottom refrigerating the load.

In an even more specific embodiment, the present invention illustrated in FIG. 1 can be used as a regular portable ice chest without dry ice contained in either compartments (315, 270). The load is placed in the storage area (420) packed in ice. As the ice melts, the excess water is collected in the bottom compartment (270) through the apertures in the lower grid ( ). This feature prevents the load in the storage area from being saturated.

The illustrated embodiment in FIG. 1 further includes, drain hole (120) which allows the liquid generated as the packed ice melts to drain outside of the storage area (420). Drain hole (120) is situated at the bottom of the outer front panel (210). Drain hole (120) can be a small manual faucet or a small cap. A conduit is formed which penetrates all the way from the bottom of outer front panel (210) through the inner insulated layer into storage area (420). When excess liquid is collected into storage area (420), the drain hole is opened by pressing a button or lifting a cap. Then, the collected water is allowed to drain through the conduit and outside storage area (420) through drain hole (120). Thus, the load contained in the storage area (420) is prevented from becoming saturated.

Figure 5:
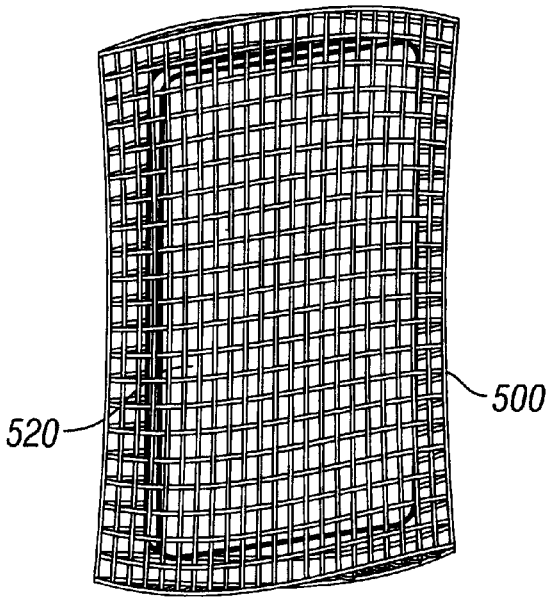
FIG. 5 is a side view of the refrigerant coolant surrounded by the protective mesh covering.

One of the problems with dry ice is that the super cold surface temperature can easily cause skin damage if touched directly. Referring now to FIG. 5, a protective mesh covering (500) is provided to prevent a user from directly touching the dry ice (520). As illustrated, the dry ice (520) is completely enclosed within the protective mesh covering (500). The mesh covering can be made of a strong net type fabric having small openings or any other type of suitable fabric. As shown, the protective covering (500) is rectangular shaped with dimensions slightly larger than a commercially available block of ice. The protective covering (500) opens from the side (530) and the dry ice (520) is placed inside protective covering (500). Then, protective covering (500) opening from the side (530) is sealed utilizing conventional means such as velcro. To support the two configurations discussed above, the protective covering (520) along with the dry ice (520) is placed within the bottom compartment (270) and inner compartment (315) in the embodiment illustrated in FIG. 1.

While only certain embodiments of the invention have been illustrated and described, it is understood that alterations, changes, and modifications may be made without departing from the true scope and spirit of the invention.

Figure 6:
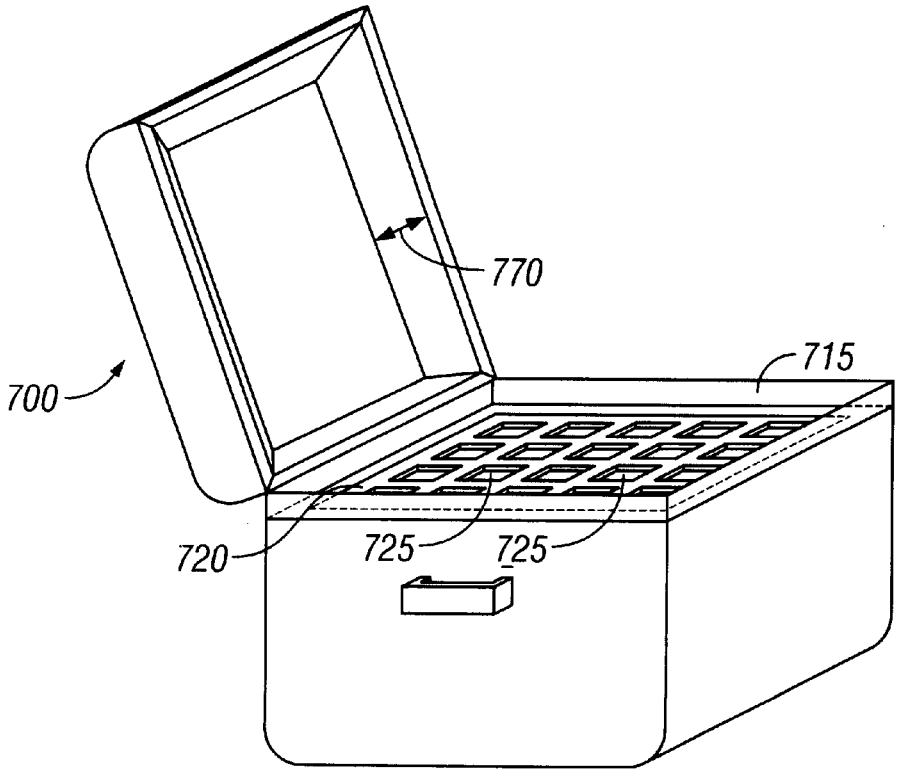
FIG. 6 illustrates an alternative embodiment of the present invention.

Referring to FIG. 6, an alternative embodiment is shown for portable ice chest (100). In the illustrated embodiment, cover (700) is hingedly connected to Cooler (200). Cooler (200) is structured as described in detailed above. In the illustrated embodiment, cover (700) is shown having an inner insulated layer (710) adapted to form an inner compartment (715). Inner compartment (715) forms an inner cavity within the cover (700). The formed inner cavity has enough area volume for containing a refrigerant coolant such as dry ice. The illustrated embodiment in FIG. 6 further includes an upper grid (720) having a plurality of apertures (725). In the illustrated embodiment, upper grid (720) is rectangular shaped. As shown, upper grid (720) has a configuration that is equivalent to the upper opening (705) of the inner compartment (715) and is built into the walls of inner compartment (715). The upper grid (720) in the illustrated embodiment can be made from a hard plastic material or other such suitable material. In the illustrated embodiment shown in FIG. 6, cover (700) further comprises an upper lid (770) which traverses from a closed position into a 90 degree opened position to allow a refrigerant coolant to be placed into inner compartment (715).

What is claimed is:

1. An all-purpose portable ice chest comprising:

a thermally insulated cooler defining a bottom compartment and a top opening;

an insulated cover being adapted to fit airtight upon the top opening of the cooler, the cover defining an upper compartment;

an upper grid having a plurality of apertures, the upper grid overlaying the upper compartment;

the upper compartment being adapted to form an inner cavity having an upper opening, a lower portion, and two opposing inner side walls;

the upper grid further comprising:

an equivalent configuration to the upper opening of the inner cavity along with slightly larger dimensions than the upper opening of the inner cavity, two opposing sides, means for hingedly connecting the first opposing side to the first opposing side wall of the inner cavity, and means for securely attaching the second opposing side to the second opposing side wall of the inner cavity;

a lower grid having a plurality of apertures, the lower grid overlaying the bottom compartment;

a storage area disposed between the top opening and the lower grid for containing a load; and a first refrigerant coolant being contained within the upper compartment for maintaining the load in a frozen state for an extended period of time.

2. The ice chest of claim 1, wherein the first refrigerant coolant is dry ice.

3. The ice chest of claim 1, wherein the cooler has a size, weight, and a configuration conducive for handheld carrying by a user.

4. The ice chest of claim 1, further comprising a second refrigerant coolant contained within the bottom compartment.

5. The ice chest of claim 1, wherein the cover is hingedly connected to the top opening of the cooler.

6. The ice chest of claim 1, wherein the cover is completely removable from the top opening of the cooler.

7. The ice chest of claim 1, wherein the bottom compartment is adapted to form a bottom cavity having an upper opening, a lower portion, and two opposing inner side walls.

8. The ice chest of claim 7, wherein the lower grid further comprises:

an equivalent configuration to the upper opening of the bottom cavity along with slightly larger dimensions than the upper opening of the bottom cavity;

two opposing sides;

means for hingedly connecting the first opposing side to the first opposing side wall of the bottom cavity; and means for securely attaching the second opposing side to the second opposing side wall of the bottom cavity.

9. The ice chest of claim 5, further comprising a means for securing the cover to the cooler.

10. The ice chest of claim 1, further comprising a means for draining the excess liquid collected within the cooler.

11. The ice chest of claim 1, further comprising:

a mesh protective covering completely encompassing the first refrigerant coolant and being stored within the inner cavity, whereby a user is prevented from directly touching the first refrigerant through the apertures in the upper grid.

12. The ice chest of claim 2, further comprising:

a mesh protective covering completely encompassing the second refrigerant coolant and being stored within the bottom cavity, whereby a user is prevented from directly touching the first refrigerant through the apertures in the lower grid.

13. The ice chest of claim 1, wherein the storage area is defined by the area disposed between the top opening and the lower portion of the bottom cavity wherein the lower grid is traversed from a closed position into an open position forming a 90 degree angle with the upper opening of the bottom cavity.

14. An all-purpose portable ice chest comprising:

a thermally insulated cooler defining a bottom compartment and a top opening;

an insulated cover being adapted to fit airtight upon the top opening of the cooler, the cover defining an upper compartment;

an upper grid having a plurality of apertures, the upper grid overlaying the upper compartment;

the upper compartment being adapted to form an inner cavity having an upper opening, a lower portion, and two opposing inner side walls;

the upper grid further comprising:

an equivalent configuration to the upper opening of the inner cavity along with slightly larger dimensions than the upper opening of the inner cavity, two opposing sides, means for hingedly connecting the first opposing side to the first opposing side wall of the inner cavity, and means for securely attaching the second opposing side to the second opposing side wall of the inner cavity;

a lower grid having a plurality of apertures, the lower grid overlaying the bottom compartment;

a storage area disposed between the top opening and the lower grid for containing a load; and a first refrigerant coolant being contained within the bottom compartment for maintaining the load in a refrigerated state for an extended period of time.

15. The ice chest of claim 14, wherein the first refrigerant coolant is dry ice.

16. The ice chest of claim 14, wherein the cooler has a size, weight and a configuration conducive for handheld carrying by a user.

17. The ice chest of claim 14, wherein the cover is hingedly connected to the top opening of the cooler.

18. The ice chest of claim 14, wherein the cover is completely removable from the top opening of the cooler.

19. The ice chest of claim 14, wherein the bottom compartment is adapted to form a bottom cavity having an upper opening, a lower portion, and two opposing inner side walls.

20. The ice chest of claim 19, wherein the lower grid further comprises:

an equivalent configuration to the upper opening of the bottom cavity along with slightly larger dimensions than the upper opening of the bottom cavity;

two opposing sides;

means for hingedly connecting the first opposing side to the first opposing side wall of the bottom cavity; and means for securely attaching the second opposing side to the second opposing side wall of the bottom cavity.

21. The ice chest of claim 18, further comprising a means for securing the cover to the cooler.

22. The ice chest of claim 14, further comprising a means for draining the excess liquid collected within the cooler.

23. The ice chest of claim 14, further comprising:

a mesh protective covering completely encompassing the second refrigerant coolant and being stored within the bottom cavity, whereby a user is prevented from directly touching the first refrigerant through the apertures in the lower grid.

24. The ice chest of claim 14, wherein the upper compartment is a second storage area for a load.

25. The ice chest of claim 14, wherein the load is packed with ice.

26. An all-purpose portable ice chest comprising:

a thermally insulated cooler defining a bottom compartment with inner side walls and a top opening;

an insulated cover being adapted to fit airtight upon the top opening of the cooler, the cover defining an upper compartment;

an upper grid having a plurality of apertures, the upper grid overlaying the upper compartment;

the upper compartment being adapted to form an inner cavity having an upper opening, a lower portion, and two opposing inner side walls;

the upper grid further comprising:

an equivalent configuration to the upper opening of the inner cavity along with slightly larger dimensions than the upper opening of the inner cavity, two opposing sides, means for hingedly connecting the first opposing side to the first opposing side wall of the inner cavity, and means for securely the second opposing side to the second opposing side wall of the inner cavity;

a lower grid having a plurality of apertures, the lower grid overlaying the bottom compartment;

the bottom compartment being adapted to form a bottom cavity having an upper opening, a lower portion, and two opposing inner side walls;

the lower grid further comprising:

an equivalent configuration to the upper opening of the bottom cavity along with slightly larger dimensions than the upper opening of the bottom cavity, two opposing sides, means for hingedly connecting the first opposing side to the first opposing side wall of the bottom cavity, and means for securely attaching the second opposing side to the second opposing side wall of the bottom cavity;

a storage area disposed between the top opening and the lower grid for containing a load; and a means for draining the excess liquid collected within the cooler.

27. A method for utilizing an ice chest as a refrigerator, freezer, or cooler, the method comprising:

providing an insulated ice chest comprising a cover having an inner compartment with a plurality of apertures, a bottom compartment having a plurality of apertures, and a storage area defined therebetween;

storing a load in the storage area;

inserting into the upper compartment a refrigerant coolant of a particular weight such that as the refrigerant coolant subliminates the gases flows through the apertures in the inner compartment down into the storage area wherein the load in the storage area is maintained in a frozen state for a predetermined period of time;

inserting into the bottom compartment a refrigerant coolant of a particular weight such that as the refrigerant coolant subliminates the gases flows through the apertures in the bottom compartment up into the storage area wherein the load in the storage area is maintained in a refrigerated state for a predetermined period of time;

cooling the load stored in the storage area wherein ice is place over the load such that as the ice melts the water flows through the apertures in the bottom compartment and is collected in the bottom compartment.

28. The method of claim 27 wherein the predetermined period of time is determined by the weight of the refrigerant coolant.

29. The method of claim 27 wherein maintaining the load in a frozen state further comprises placing a second refrigerant in the bottom compartment such that the predetermined period of time is extended.

30. The method of claim 27 wherein the refrigerant coolant is dry ice.

31. An all-purpose portable ice chest comprising:

a thermally insulated cooler defining a bottom compartment and a top opening;

an insulated cover being adapted to fit airtight upon the top opening of the container, the cover defining an upper compartment;

an upper grid having a plurality of apertures, the upper grid overlaying the upper compartment;

a lower grid having a plurality of apertures, the lower grid overlay the bottom compartment;

a storage area disposed between the top opening and the lower grid for containing a load;

a means for maintaining the load in a frozen state for a predetermined period of time, wherein a refrigerant coolant is inserted into the upper compartment such that as the refrigerant coolant sublimates the gases flows through the apertures in the inner compartment down into the storage area;

a means for maintaining the load in a refrigerated state for a predetermined period of time, wherein a refrigerant coolant is inserted into the bottom compartment such that as the refrigerant coolant sublimates the gases flows through the apertures in the bottom compartment down up into the storage area; and means for cooling the load stored in the storage area wherein ice is place over the load such that as the ice melts the water flows through the apertures in the bottom compartment and is collected in the bottom compartment.

32. An all-purpose portable ice chest comprising:

a thermally insulated cooler defining a bottom compartment and a top opening;

an insulated cover being adapted to fit airtight upon the top opening of the cooler, the cover defining an upper compartment;

an upper grid having a plurality of apertures, the upper grid overlaying the upper compartment;

a lower grid having a plurality of apertures, the lower grid overlaying the bottom compartment;

the bottom compartment being adapted to form a bottom cavity having an upper opening, a lower portion, and two opposing inner side walls;

the lower grid further comprising:

an equivalent configuration to the upper opening of the bottom cavity along with slightly larger dimensions than the upper opening of the bottom cavity, two opposing sides, means for hingedly connecting the first opposing side to the first opposing side wall of the bottom cavity, and means for securely attaching the second opposing side to the second opposing side wall of the bottom cavity;

a storage area disposed between the top opening and the lower grid for containing a load; and a first refrigerant coolant being contained within the upper compartment for maintaining the load in a frozen state for an extended period of time.

33. An all-purpose portable ice chest comprising:

a thermally insulated cooler defining a bottom compartment and a top opening;

an insulated cover being adapted to fit airtight upon the top opening of the cooler, the cover defining an upper compartment;

an upper grid having a plurality of apertures, the upper grid overlaying the upper compartment;

a lower grid having a plurality of apertures, the lower grid overlaying the bottom compartment;

the bottom compartment being adapted to form a bottom cavity having an upper opening, a lower portion, and two opposing inner side walls;

the lower grid further comprising:

an equivalent configuration to the upper opening of the bottom cavity along with slightly larger dimensions than the upper opening of the bottom cavity, two opposing sides, means for hingedly connecting the first opposing side to the first opposing side wall of the bottom cavity, and means for securely attaching the second opposing side to the second opposing side wall of the bottom cavity;

a storage area disposed between the top opening and the lower grid for containing a load; and a first refrigerant coolant being contained within the bottom compartment for maintaining the load in a refrigerated state for an extended period of time.

* * * * *